US005637427A

United States Patent [19]

Yamamoto et al.

[11] Patent Number: 5,637,427

[45] Date of Patent: Jun. 10, 1997

[54] FULL COLOR TONER FOR ELECTROSTATIC CHARGE DEVELOPMENT, METHOD FOR PRODUCING THE TONER, AND IMAGE FORMING METHOD USING THE TONER

[75] Inventors: Yasuo Yamamoto; Susumu Saito; Yutaka Sugizaki; Kaoru Torikoshi, all of Minami-ashigara, Japan

[73] Assignee: Fuji Xerox Co., Ltd., Tokyo, Japan

[21] Appl. No.: 611,179

[22] Filed: Mar. 5, 1996

[30] Foreign Application Priority Data

Mar. 7, 1995 [JP] Japan ..... 7-072442

[51] Int. Cl.[6] ..... G03G 13/01; G03G 9/087

[52] U.S. Cl. ..... 430/45; 430/109; 430/137

[58] Field of Search ..... 430/109, 137, 430/45

[56] References Cited

U.S. PATENT DOCUMENTS

| | | | |
|---|---|---|---|
| 2,962,374 | 11/1960 | Dessauer | 430/42 |
| 5,258,255 | 11/1993 | Shimizu et al. | 430/110 |
| 5,294,682 | 3/1994 | Fukuda et al. | 430/109 |
| 5,407,772 | 4/1995 | Bayley et al. | 430/109 |
| 5,429,898 | 7/1995 | Sugizaki et al. | 430/45 |
| 5,437,954 | 8/1995 | Saito | 430/111 |

FOREIGN PATENT DOCUMENTS

| | | |
|---|---|---|
| 59-218463 | 12/1984 | Japan . |
| 60-129756 | 7/1985 | Japan . |
| 62-127847 | 6/1987 | Japan . |
| 62-280755 | 12/1987 | Japan . |
| 2-293858 | 12/1990 | Japan . |
| 2-293867 | 12/1990 | Japan . |
| 3-107869 | 5/1991 | Japan . |
| 3-107870 | 5/1991 | Japan . |
| 3-115568 | 5/1991 | Japan . |
| 3-122664 | 5/1991 | Japan . |
| 3-185459 | 8/1991 | Japan . |
| 3-269542 | 12/1991 | Japan . |
| 3-269543 | 12/1991 | Japan . |
| 4-242752 | 8/1992 | Japan . |
| 4-337738 | 11/1992 | Japan . |
| 6-75430 | 3/1994 | Japan . |

*Primary Examiner*—Roland Martin
*Attorney, Agent, or Firm*—Oliff & Berridge

[57] ABSTRACT

A color toner and a black toner for electrostatic charge development comprises a binder resin and a colorant, wherein the binder resin comprises a polyester resin containing (a) an ethoxylated bisphenol type diol, (b) a propoxylated bisphenol type diol and (c) an aromatic dicarboxylic acid or an anhydride or ester thereof, as main monomer components, and the polyester resin further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of the polyester resin, and the colorant is a flushing pigment comprising hydrous paste of an organic pigment and the polyester resin, or comprising a carbon black having a primary particle size of from not less than 30 nm to not more than 50 nm. Furthermore, a method for producing the color toner and the black toner, and an method for forming a full color image using the color toners or using the color toners and the black toner in combination, are disclosed.

17 Claims, No Drawings

FULL COLOR TONER FOR ELECTROSTATIC CHARGE DEVELOPMENT, METHOD FOR PRODUCING THE TONER, AND IMAGE FORMING METHOD USING THE TONER

FIELD OF THE INVENTION

The present invention relates to a full color toner for electrostatic charge development used in a heat roller fixing process in electrophotography, electrostatic printing, etc., a method for producing the same, and a full color toner composition. This full color toner is suitable for use in digital copying machines.

BACKGROUND OF THE INVENTION

A developing procedure of an electrostatic charge image is a procedure of attracting fine charged particles by electrostatic attraction to allow them to adhere to a surface of a support for the electrostatic charge image, and visualizing it. As a developer, a toner comprising a binder resin and a colorant contained therein is used. In some cases, the visualized image is transferred to the support as it is and fixed. Usually, however, the image is transferred to another support such as transfer paper, followed by fixing. Fixing systems include non-contact heat fixing systems such as oven fixing and contact heat fixing systems such as heat roller fixing. In general, the contact heat fixing systems are superior to the other because of their high thermal efficiency and high-speed fixing. Use of a heat roller in the contact heat fixing system can reduce power consumption, because a heat source of relatively low temperature can be used, which makes it possible to miniaturize copying machines and to save energy. Further, there is no danger of firing even when paper jamming takes place in a fixing device.

The heat roller fixing system has various advantages as described above, but has a serious disadvantage that offset is liable to occur. The term "offset" means a phenomenon that a toner constituting an image is partly transferred to a surface of a heat roller in fixing and transferred to transfer paper subsequently supplied, to thereby stain the image. As methods for preventing this phenomenon, there are proposed a method of conducting fixing while applying a surface lubricating oil such as a silicone oil to a surface of a heat roller, and a method of adding a wax represented by a polyolefin to a toner itself to impart the offset preventing property as described in JP-A-3-122664 (the term "JP-A" as used herein means an "unexamined published Japanese patent application").

For the latter method, a silicone oil coating mechanism or the like are not required, so that the structure of a fixing device becomes simple, and maintenance such as supply of the silicone oil is unnecessary. However, the wax added to the toner deteriorates the transparency of the image after fixing, because of its insufficient compatibility with a binder resin. Deterioration of the transparency does not directly lead to a problem for a monochrome copy, but arises a problem when a full color image is formed in which importance is attached to the transparency of light. It should be therefore avoided to compound the above-described wax as far as possible.

Then, the development of full color toners used in the former method, namely a oil supply type heat roller fixing method, has been desired.

Recently, in printers, facsimiles and copying machines, the demand for color copies having a large amount of information has been increased, and the image quality thereof has also been improved year by year. As a method for forming a color copy, the method described in U.S. Pat. No. 2,962,374 is generally used in which at least three electrostatic latent images are formed based on a three-color synthesis system such as a subtractive color process, and then developed with different toners of at least three colors to synthesize an image on copying paper. The color toners used in this method require development and maintenance of suitable colors, as well as mechanical, environmental and electrical stabilities to external factors such as shock, humidity and temperature. It is therefore required to optimize the design of binder resins of the toners, the kind and amount of colorants, and methods for dispersing the colorants.

As the colorants of the color toners, colorants of the organic pigment family are superior to colorants of the dye family from the viewpoints of light resistance, transfer resistance and safety. However, commercially available organic pigments in the dried powder state have the problem that it is difficult to disperse them in the binder resins. If primary particles of the pigment exist as aggregates in the toners, the light permeability which is the most important characteristic in the full color images is significantly deteriorated, resulting in a substantial deterioration of color reproduction. It becomes therefore difficult to apply them to a film for overhead projectors (OHPs).

As methods for overcoming the above-described disadvantage of the organic pigments, methods are proposed in which a commercially available organic solvent is mixed with a binder resin of a toner by heat melting at a concentration higher than a concentration of a pigment used in usual toners to produce a processed pigment, and then, the above-described processed pigment is diluted with the binder resin so as to give an optimum pigment concentration as the toner, followed by melt-mixing, thereby reducing dispersed unit of the organic pigment in the toner, as described in JP-A-62-280755, JP-A-2-293867, JP-A-3-107869, JP-A-3-107870, JP-A-3-115568, JP-A-3-185459, JP-A-3-269542 and JP-A-3-269543.

However, the commercially available organic pigments could not avoid the aggregation of the primary particles of the organic pigment at the drying stage in the production of the pigment, and could not be finely dispersed to a degree that the light permeability of the resulting toner was not affected.

Then, as an alternate method for reducing the dispersed unit of the organic pigment in the toner, JP-A-62-127847 proposes a method in which an organic pigment such as phthalocyanine deposited in a solution at the stage of pigment process is washed and concentrated, followed by heat mixing with an organic solvent in which a resin is dissolved, water and the organic solvent are removed to prepare a resin composition containing the organic pigment finely dispersed therein at a relatively high concentration (hereinafter referred to as a "flushing pigment"), and the flushing pigment is melt-kneaded with a binder resin, followed by pulverization to obtain the toner. The toner obtained by this method is fairly good in light permeability and color reproduction, compared with the above-described processed pigments.

However, when the pigment is pigment-processed, for example, from phthalocyanine in this method, phthalocyanine prepared by an acid paste process or an acid slurry process is used. Accordingly, α-form phthalocyanine crystals are formed, and β-form phthalocyanine crystals excellent in color reproduction can not be obtained. Further, the above-described method can not be applied to azo lake magenta pigments or yellow pigments synthesized by an azo coupling process. Moreover, use of the organic solvent for replacing water present in hydrous paste necessitates recovery of the organic solvent. In the acid paste process or the acid slurry process, use of concentrated sulfuric acid causes the possibility of remaining of sulfuric acid in the pigment even after washing, and when a polyester is used as a binder resin, ester linkages of the polyester are disadvantageously hydrolyzed to change the characteristics of the toner.

In order to solve these problems, the present inventors previously proposed a full color toner substantially improved in light permeability and color reproduction by controlling a dispersed unit of a pigment (JP-A-4-242752). A method for producing this toner comprises the steps of heating hydrous paste of an organic pigment together with a binder resin, heat-mixing them in a pressure kneader at a temperature of 100° C. or more to remove water by replacement with the molten resin, thus preparing a resin containing the organic pigment dispersed therein at a high concentration (hereinafter referred to as a "melt flushing pigment"), then melt-kneading with the binder resin, and pulverizing the resulting mixture.

The hydrous paste of the phthalocyanine pigment can be produced by the salt milling process in which water, a salt and a pigment are pulverized in a pulverizing mill applying high shear stress to obtain finely divided pigment particles. Further, hydrous paste of an azo lake magenta pigment prepared by lake formation from an azo dye can be produced by preparing a pigment dispersion in the coexistence of a rosin derivative to prevent the pigment from aggregating in lake formation, and concentrating the dispersion.

The adoption of the above-described method for producing the melt flushing pigment makes it possible to control the dispersed unit of the pigment into the toner and to improve the color reproduction and the light permeability. By the way, in the case of the full color toner, a polymer having a relatively low molecular weight and a narrow molecular weight distribution, for example, a polyester resin having a number average molecular weight of 3,200, a weight average molecular weight of 9,800 and a glass transition point of 66° C., is used in order to ensure high luster, high color development and good fixing property at low temperature. As a result, use of the melt flushing pigment arises the problem that the toner rapidly melts in excess at a temperature exceeding a certain temperature to cause adhesion to a fixing roll or impregnation to paper, resulting in a reduction in image quality.

To solve the above described problems, a binder resin having a higher molecular weight might be used as long as the above described high luster, high color development and good fixing property at low temperature are not impaired. However, such a method is disadvantageous in that the molecular weight of the binder resin in the resulting melt flushing pigment is fluctuated, because the binder resin is shear-mixed with a high concentration of organic pigment in melt-flushing stage, to thereby the physical properties of the resulting toner are fluctuated. As a result, the production stability is impaired.

It has been therefore desired to develop binder resins suitable for the production of the melt flushing pigments.

As a binder resin of a toner, vinyl polymers have previously been widely used, and use of polymers having a high molecular weight has been proposed to obtain the non-offset property. However, the temperature of heat rollers is required to be established high to obtain fixed images having excellent luster, because of the high softening point of the vinyl polymer having a high molecular weight. This results in reverse movement against energy saving. Further, the toner using a vinyl polymer is liable to be attacked with a plasticizer contained in a vinyl chloride resin, and the toner itself is plasticized by contact with the plasticizer to become tacky. As a result, the plasticized vinyl chloride resin products are contaminated. That is, there is a problem with regard to the vinyl chloride resistance characteristic.

In contrast, polyester resins are excellent in vinyl chloride resistance characteristic, and low molecular weight polyester resins can be relatively easily produced. Further, the polyester resins also have the advantage that they are good in wetting to a support such as transfer paper when melted, compared with the toner in which a vinyl polymer is compounded as a binder resin, so that sufficient fixing can be conducted at a lower temperature, compared with the vinyl polymer having an approximately similar softening point. The polyester resins have therefore been come into use as a binder resin for a toner.

In JP-A-4-242752 described above, also in order to ensure the production stability in shear mixing at the melt flushing stage, a polyester obtained from terephthalic acid/bisphenol A-ethylene oxide addition product/cyclohexanedimethanol is used as the binder resin, said polyester having, for example, a number average molecular weight of 3,000 to 3,600, a weight average molecular weight of 8,700 to 9,500, a softening point of 100° to 125° C. and a glass transition point of 55° to 68° C. The polyester resin independently containing the bisphenol A-ethylene oxide addition product has a high strength, so that the above-described production stability is excellent and the fixing strength is also excellent. However, the polyester resin is very poor in pulverizing property in the toner production, and therefore, it has the problem that the production efficiency is low, resulting in too high toner cost to be practically used.

In general, the production cost of the toners produced through the respective stages of melt-kneading, pulverization and classification is mostly occupied by the cost of the pulverization and classification stages. The pulverizing property of the binder resins is therefore a very important factor in the toner production. In digital copying machines for which the future demand is promised, the tendency of toners to be reduced in particle size is increased, and at present, it is necessary to pulverize the toners to 7 μm or less. The pulverizing property of the binder resins is therefore an important factor.

The toners in which the above-described polyester are used as the binder resins can be pulverized with jet pulverizers, etc., but a large amount of energy is required. In addition, the resulting pulverized products are strong in aggregation property, and poor in fluidity as powders, resulting in poor classification efficiency. Such toners strong in aggregation property are difficult to be uniformly mixed with external additives, and the external additives can not uniformly adhere to surfaces of the toners. Further, adhesion and fusion of the toners to pipes of the pulverizers, inner walls of pulverizing chambers, collision plates, etc. markedly take place, which causes a reduction in toner productivity.

Of the polyester-containing binder resins, therefore, it has been desired to develop resins suitable for the production of the melt flushing pigments and excellent in toner productivity.

On the other hand, in the full color toners, a black toner is generally used in combination with cyan, magenta and yellow toners to obtain clear black color in color images.

Previously, carbon black has been commonly used as a coloring material in monochrome toners.

As a use example of carbon black in the monochrome toner, JP-A-59-218463 discloses that carbon black is added in an amount of 15% by weight or more based on the total weight of toner for giving a high-density black color and improving environmental charging stability, transferring property and development life. However, this toner can not faithfully reproduce colors from a low-density region to a high-density region, that is, from a light gray color to a deep black color.

Further, JP-A-60-129756 discloses that carbon black is added in an amount of 0.1 to 2.0 parts by weight based on 100 parts by weight of binder resin for providing a color toner having a good frictional charging property. For the toner containing such an amount of carbon black, the amount of toner developed is required to be increased to reproduce a high-density black color. As a result, problems such as fog to non-image portions and scattering of the toner to the periphery of a developing machine are encountered. Moreover, the amount of carbon black within this range gives wholly reddish-brown copies.

It has been therefore desired to develop black toners for forming full color images excellent in the above-described black color reproduction, productivity, etc.

On the other hand, with the spread of digital full color copying machines, the stability in image quality of copies, higher image quality and higher reproduction have been desired.

For realizing high image quality and high reproduction of color copies, use of small-sized color toners is proposed in JP-A-4-337738 and JP-A-6-75430. However, it is described therein that development, transfer and cleaning characteristics are deteriorated as the size of the toners is decreased, and that the stability and maintenance of image quality of copies are poor. Further, it is also described that the powder fluidity is deteriorated by a reduction in particle size of the toners, and that the frictional charging property with carriers and the environmental charging stability are also deteriorated.

As countermeasures for solving these problems, external additives externally added to a toner are studied. The present inventors previously proposed a method of externally adding fine spherical inorganic or organic particles having a particle size of 20 to 80 nm in JP-A-4-337738, and a method of externally adding titanium oxide particles having a particle size of 0.01 to 0.2 μm in JP-A-6-75430.

However, even by these methods, the stable development, transfer and cleaning characteristics and environmental charging stability have not been obtained yet under the present conditions, and the image stability for a long period has been required. It has been therefore desired to provide full color toner images stable in image quality to environmental fluctuations and long-term use.

SUMMARY OF THE INVENTION

It is therefore an object of the present invention to solve the above-described various problems of the prior art.

Another object of the present invention is to provide a full color toner for electrostatic charge development, and to provide a method for producing the full color toner satisfying the following requirements:

(1) In the heat roller fixing system, the toner is excellent in color development, melt miscibility and color reproduction after melt-mixed;

(2) Even when fixed on a film sheet for an overhead projector, the toner is excellent in light permeability of a fixed image;

(3) An image having a sufficient fixing strength on a transfer member can be formed. In particular, an image excellent in fixing strength to a sheet for an overhead projector, etc. can be formed;

(4) In the production of a toner, the pulverizing efficiency is excellent, the classification efficiency is high, and the production cost is low. In particular, it is effective for the production of a small-sized toner which can be applied to a digital copying machine, etc.;

(5) A toner excellent in powder fluidity and non-aggregation property and good in resupplying property and preservability can be provided;

(6) The toner has a stable frictional charging property under various humidity conditions;

(7) In the continuous repetitive use, excellent durability is shown, and an image having an excellent quality can be stably provided;

(8) In a two-component system developer, staining of a carrier caused by adhesion and fusion to the carrier can be prevented;

(9) A toner excellent in development characteristics can be provided which can obtain high image quality sufficient in image density, light, sharp, resolutive and having no background fog;

(10) A toner can be provided which does not induce blocking in storage of the toner or keeping thereof in equipment, and does not adhere to or stain a toner carrying member or an electrostatic charge image;

(11) A black toner is provided which is excellent in color reproduction from white to gray and black, also in a full color image, and excellent in reproduction of density gradation from low density to high density;

(12) When a color image is formed using respective toners of cyan, magenta, yellow and black, the color image excellent in transparency, color reproduction and color clearness can be formed; and

(13) A toner can form an image excellent in fixing strength on a transfer member such as an OHP sheet or paper, and has a sufficient fixing permissible range.

The present inventors have found that the above-described objects can be accomplished by preparing a full color toner using a melt flushing pigment and carbon black having a specific particle size, each together with a binder resin containing a specific polyester resin, and further by preparing a toner composition in which a specific titanium oxide particles having a specific particle size are externally added to the full color toner, thus completing the present invention.

That is, the above objects of the present invention has been achieved by providing a full color toner for electrostatic charge development comprising the following color toner and black toner, and by providing the following method for producing the color toner.

The color toner for electrostatic charge development of the present invention comprises a binder resin and a color colorant, wherein said binder resin comprises a polyester resin containing (a) an ethoxylated bisphenol type diol, (b) a propoxylated bisphenol type diol and (c) an aromatic dicarboxylic acid or an anhydride or ester thereof, as main monomer components, and further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said color colorant is a melt flushing pigment comprising hydrous paste of an organic pigment and said polyester resin.

In the above color toner, the organic pigment is dispersed in the binder resin so that a proportion of the number of dispersed pigment particles having a circle-corresponding diameter of 0.3 μm or more to the total number of the dispersed pigment particles being 0.1% or less.

The black toner for electrostatic charge development comprises a binder resin and a black colorant, wherein said binder resin comprises a polyester resin containing (a) an ethoxylated bisphenol type diol and (b) a propoxylated bisphenol type diol and (c) an aromatic dicarboxylic acid or an acid anhydride or ester thereof as main monomer components, and further containing at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said black colorant is a carbon black having a primary particle size of from not less than 30 nm to not more than 50 nm.

To the color toner and the black toner of the present invention, an external additive may be added. The external additive is preferably titanium oxide particles produced by a wet process, and preferably contains a water-soluble components in an amount of 0.2% by weight or less based on the total weight thereof. Furthermore, the external additive is preferably surface treated with a surface treating agent, preferably, a coupling agent or a silicone oil.

The method for producing a color toner for electrostatic charge development of the present invention comprises the steps of:

melt-kneading in a heat-pressure type kneader (i) an organic pigment and (ii) a polyester resin containing (a) an ethoxylated bisphenol type diol (b) a propoxylated bisphenol type diol and (c) an aromatic dicarboxylic acid or an acid anhydride or ester thereof as main monomer components, and further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin to prepare a melt flushing pigment;

melt-kneading said melt flushing pigment and said polyester resin; and pulverizing and classifying the resulting melt-kneaded product.

In the above described method, the melt-kneading in the heat-pressure type kneader is preferably conducted at a temperature of 100° to 150° C.

DETAILED DESCRIPTION OF THE INVENTION

The present invention is described in detail below.

The polyester resin constituting the binder resin used in the color toner and the black toner for electrostatic charge development of the present invention comprises (a) an ethoxylated bisphenol type diol, (b) a propoxylated bisphenol type diol and (c) an aromatic dicarboxylic acid or an acid anhydride or ester thereof as main monomer components, and the polyester resin further comprises (d) at least one compound selected from the group consisting of alkylsuccinic acids, acid anhydrides and esters thereof, alkenylsuccinic acids, and acid anhydrides and esters thereof in an amount of from 7 to 25 mol % based on the total monomer amount of the polyester resin. The polyester resin is produced using (a) an ethoxylated bisphenol type diol, (b) a propoxylated bisphenol type diol and (c) an aromatic dicarboxylic acid or an acid anhydride or ester thereof, as main components, and (d) at least one compound selected from the group consisting of alkylsuccinic acids, acid anhydrides and esters thereof, alkenylsuccinic acids, and acid anhydrides and esters thereof as a minor component.

The ethoxylated bisphenol type diols or the propoxylated bisphenol type diols are obtained by ethoxylation or propoxylation of bisphenol, and include compounds having from 2 to 7 mol of oxyethylene or oxypropylene per mol of bisphenol. For example, they are represented by the following general formula:

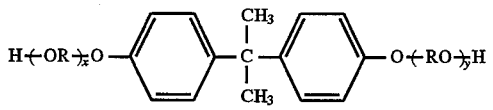

wherein R represents an ethylene group or a propylene group, x and y each represents an integer of 1 or more, and an average value of x+y is 2 to 7.

Specific examples thereof include polyoxyethylene(2.2)-2,2-bis(4-hydroxyphenyl)propane, polyoxyethylene(1.5)-2,2-bis(4-hydroxyphenyl)propane, polyoxypropylene(2.2)-2,2-bis(4-hydroxyphenyl)propane, polyoxypropylene(6)-2,2-bis(4-hydroxyphenyl)propane and polyoxypropylene(2.2)-2,2-bis(4-hydroxy-2,6-dichlorophenyl)propane. Of these, polyoxyethylene(2.2)-2,2-bis(4-hydroxyphenyl)propane, polyoxyethylene(1.5)-2,2-bis(4-hydroxyphenyl)propane, polyoxypropylene(2.2)-2,2-bis(4-hydroxyphenyl)propane, polyoxypropylene(6)-2,2-bis(4-hydroxyphenyl)propane are preferred. These etherified bisphenol type diols can be produced by directly adding ethylene oxide or propylene oxide to a diphenol or reacting an olefin halohydrin with a diphenol.

The molar ratio of the ethoxylated bisphenol type diol to the propoxylated bisphenol type diol is preferably from 1:10 to 10:1, and more preferably from 1:4 to 4:1.

The polyesters used in the present invention may contain an aliphatic polyol such as ethylene glycol, propylene glycol, 1,4-butanediol, 1,5-pentanediol, 1,6-hexanediol, glycerol, trimethylolethane, trimethylolpropane and pentaerythritol, and an alicyclic alcohol such as 1,4-cyclohexanediol and 1,4-cyclohexanedimethanol, as another alcohol component, as long as the features of the present invention are not impaired. Of the above described aliphatic polyol, ethylene glycol is preferred.

On the other hand, examples of the aromatic dicarboxylic acid include aromatic carboxylic acids such as terephthalic acid, isophthalic acid and phthalic acid. Examples of anhydrides thereof include phthalic anhydride. Further, examples of esters thereof include lower molecular weight alkyl esters of the above-described dicarboxylic acids such as dimethyl terephthalate, diethyl terephthalate and dimethyl isophthalate. Of these, terephthalic acid and diethyl terephthalate are preferred. The above described dicarboxylic acid or an anhydride or ester thereof is generally used in the same mole amount with the diol components.

Furthermore, examples of the alkylsuccinic acids, the alkenylsuccinic acids, and acid anhydrides and esters thereof include n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid, anhydrides thereof and lower alkyl esters thereof. Of these, n-octyl-succinic acid, n-octenylsuccinic acid, n-dodecylsuccinic acid, n-dodecenylsuccinic acid, isododecylsuccinic acid, isododecenylsuccinic acid and anhydrides thereof are preferred.

In the present invention, it is particularly important that the polyester resin contains the ethoxylated bisphenol, propoxylated bisphenol and aromatic dicarboxylic acid components, and further contains at least one compound selected from the group consisting of the alkylsuccinic acids, acid anhydrides and esters thereof, the alkenylsuccinic acids, and acid anhydrides and esters thereof in an amount of 7 to 25 mol % based on the total monomer molar amount of the polyester resin. That is, the propoxylated bisphenol component is effective for improvements in pulverizing property, powder property and preservability, and the ethoxylated bisphenol component is effective for an improvement in fixing strength. The alkylsuccinic acid, the alkenylsuccinic acid and the anhydride thereof effectively function for improvements in fixing property at low temperature, powder property, impact resistance and surface lubricating property.

If the content of the alkylsuccinic acid, alkenylsuccinic acid and its anhydride and ester components exceeds 25 mol %, the glass transition temperature (Tg) of the polyester resin is decreased too low, resulting in poor preservability, not to be suitable for practical use. On the other hand, if the content is less than 7%, effects are not exerted in fixing property at low temperature, powder property, impact resistance and surface lubricating property. The content is particularly preferably within the range of from 8 to 15 mol %, and adjustment to that range makes it possible to provide the toner having the above-described features.

Further, use of the resin containing the alkylsuccinic acid, the alkenylsuccinic acid, anhydride thereof and/or ester thereof increases the affinity for the colorant to improve the dispersibility, because of the lipophilicity of the alkyl group or the alkenyl group. Furthermore, it is considered that the good dispersibility makes it difficult to make a surface of the toner brittle, which can prevent embedding of the external additive, resulting in no poor electrification.

The above-described polyester resin for use in the present invention preferably has a glass transition point of from 50° to 80° C., more preferably from 55° to 70° C. and particularly preferably from 60° to 65° C., and a softening point of from 80° to 150° C., more preferably from 90° to 140° C. and particularly preferably from 95° to 135° C. A glass transition point exceeding 80° C. necessitates a large amount of thermal energy in heat fixing, resulting in disturbance of high-speed heat fixing. A softening point of less than 80° C. decreases the offset resistance in fixing. When the glass transition point is less than 50° C., the storage quality and the preservability are inadequate. When the softening point is higher than 150° C., disadvantages arise such that the optimum temperature in fixing is elevated, that the luster of images is liable to be decreased, and that the power consumption required at the fixing stage is increased. Further, the weight average molecular weight of the above-described polyester resin for use in the present invention is generally from 5,000 to 40,000, preferably from 6,500 to 35,000, and more preferably from 7,500 to 33,000. A weight average molecular weight of less than 5,000 brings about the disadvantage of decreased fixed image strength, whereas a weight average molecular weight exceeding 40,000 brings about the disadvantage of reduced productivity in pulverization.

In the present invention, the glass transition temperature (Tg) was measured according to the DSC method (heating rate: 10° C./minute) as defined in JIS K7122 (1987), and Tg described in this specification indicates the glass transition temperature at peak point (Tmg).

The weight average molecular weight of the binder resin for use in the toner of the present invention is measured by use of a JASCO TRI ROTAR-VI HPLC system (manufactured by Nippon Bunkou Co.) according to the method described in JIS K124 (1983), in which gel permeation chromatography (GPC) is employed using TSK gel-2,000, -3,000, -4,000 and -5,000 (manufactured by Tosoh Corporation) as columns and THF as a solvent.

The binder resin for use in the toner of the present invention may contain another known binder resin as long as their characteristics are not impaired. Examples thereof include polyester resins other than the above-described polyesters in the present invention, silicone resins, epoxy resins and styrene resins. When one or more of these resins are mixed, the above-described polyester resin for use in the present invention is preferably contained in an amount of 30% by weight or more, particularly 60% by weight or more, based on the total weight of the binder resins.

When the organic pigments are used as the colorants for the full color toner in the present invention, it is necessary to uniformly disperse the organic pigments as fine particles in the binder resin. Typical examples of the organic pigment for use in the present invention include C.I. Pigment Red 48:1, C.I. Pigment Red 122, C.I. Pigment Red 57:1, C.I. Pigment Red 238, C.I. Pigment Yellow 97, C.I. Pigment Yellow 17, C.I. Pigment Yellow 185, C.I. Pigment Yellow 180, C.I. Pigment Yellow 3 and C.I. Pigment Blue 15:3.

The organic pigment is preferably dispersed in the binder resin so that the proportion of the number of pigment particles having a circle-corresponding diameter of generally 0.3 μm or more, preferably 0.2 μm or more, more preferably 0.1 μm or more, to the total number of the organic pigment is 0.1% or less. When the proportion of the pigment particles having a circle-corresponding diameter of 0.3 μm or more exceeds 0.1%, the absorbance at the same pigment concentration decreases, and the brightness and clearness of a projected image decrease.

In the present invention, the circle-corresponding diameter of pigment particles is measured in the following manner. That is, a color toner in which the pigment particles have been dispersed in a binder resin is cut with a microtome to make a slice. Then, a light photomicrograph is taken at a magnification of 600 times, and measurement is made for the photomicrograph by use of an image analysis apparatus. Details of the measurement method of the circle-corresponding diameter and those of the proportion of pigment particles having a specific diameter are described in JP-A-4-242752.

The full color toner for electrostatic charge development of the present invention is generally produced by first melt-kneading in a heat-pressure type kneader the hydrous paste of the organic pigment and the above-described binder resin to prepare the melt flushing pigment excellent in pigment dispersibility, melt-kneading the melt flushing pigment with the above-described binder resin, and pulverizing the resulting product, thereby uniformly dispersing the organic pigment particles as fine particles in the binder resin.

The melt flushing pigment is generally produced by melt-kneading the hydrous paste of the organic pigment and the above-described binder resin in a heat-pressure type kneader at the pressure of 0.5 to 5 kgf/cm$^2$, at a temperature of 100° to 150° C. and at a rotor peripheral speed of 3 to 25 cm/second.

The content of the organic pigment is generally from 2 to 30% by weight, preferably from 3 to 20% by weight, based on the total weight of the toner. A content of less than 2% by weight reduces coloring power, whereas a content exceeding 30% by weight decreases transparency, both not satisfying the requirements for the full color toners. In particular, a content within the range of from 3 to 20% by weight can significantly improve the image graininess of halftone portions of the color toner. In addition, the content of the organic pigment in the melt flushing pigment is generally from 10 to 40% by weight. Furthermore, the content of the melt flushing pigment in the toner is generally from 5 to 100% by weight, as calculated.

In the present invention, when the black toner is prepared as the full color toner, carbon black is used as the colorant. Carbon black for use in the present invention is required to have an average primary particle size of from not less than 30 nm to not more than 50 nm according to observation under an electron microscope, preferably from not less than 40 nm to 50 nm, and more preferably from not less than 40 nm to not more than 48 nm. When the primary particle size is less than 30 nm, color rendering properties are deteriorated. Namely, when a light source is changed, the color tone varies, resulting in the difficulty in obtaining an image having good gradation. On the other hand, when the primary particle size exceeds 50 nm, the amount of carbon black internally added to the toner is required to be increased to increase the black density of image quality. As a result, the saturation electrification amount of the toner decreases, resulting in deterioration of image quality.

In the present invention, carbon black is generally compounded in an amount of from 2 to 10% by weight, preferably from 3 to 9% by weight, in the toner particles. When the amount compounded is less than 2% by weight, a desired image density can not be obtained. Exceeding 10% by weight results in too high conductivity to obtain a desired electrification amount.

The black toner of the present invention may be produced by melt-kneading carbon black described above with the above-described binder resin and the additive described below which is optionally added, in a Bumbury mixer, a kneader, a continuous mixer, a roll mill, an extruder or the like, and cooling the resulting mixture, followed by crude pulverization, fine pulverization in a jet mill or the like and classification with a classifier.

The full color toners and the black toner for electrostatic charge development of the present invention generally has a 50% volume average particle diameter of from 3 to 8 μm, preferably from 4 to 7 μm. When the 50% volume average particle diameter is less than 3 μm, it becomes difficult to pulverize the particles with a jet type pulverizer, and the cloud in a copying machine occurs too markedly to be fit for practical use in office circumstances. Exceeding 8 μm results in deterioration of the sharpness of image quality and difficulty in reproducing fine image quality. In the present invention, the particle size is measured with the Coulter multisizer II®.

In the particle size distribution of the full color toner and the black toner for electrostatic charge development of the present invention, a value of a 16% volume average particle diameter divided by a 84% volume average particle diameter is preferably within the range of from 1.4 to 1.8, and more preferably within the range of from 1.5 to 1.75. When the above-described value is less than 1.4, the classification yield is decreased to 20% or less at the classification stage in the toner production, resulting in extremely high cost of the toners. When the value exceeds 1.8, the rising of electrification is slow because of too wide particle distribution of the toners, and fog on background areas become marked to deteriorate copy image quality because of wide electrification distribution. Further, fluctuations of particle size in a developing machine with time is become large, so that it is difficult to obtain stable image quality.

Other known additives may be added to the full color toner and the black toner for electrostatic charge development of the present invention, as long as the characteristics thereof are not impaired. Specifically, a colorless or hypochromic charge controlling agent, auxiliary fixing agent, etc. such as metal salicylates, boron-containing compounds and quaternary ammonium salts may be added to the binder resin.

Further, the external additives may be added to the full color toner and the black toner for electrostatic charge development of the present invention. As the external additives, any known additives such as silica and alumina may be used. In particular, the titanium oxide described below is preferably externally added. The addition of the external additives increases the uniformity of charges on the surfaces of the toner particles and accelerates the speed of the charge exchange among the toner particles while maintaining the electrification amount of the toners necessary for development under the circumstances of high temperature and high humidity, thereby improving the speed of electrification and sharpening the distribution of charges. As a result, the environmental dependency of the electrification amount of the toner composition is substantially improved. In particular, when the polyester resin is used as the binder resin as in the present invention, the disadvantage of the polyester resin with regard to the environmental dependency of electrification as described above is preferably overcome.

In the present invention, surface-treated titanium oxide produced by the wet process and containing 0.2% by weight or less of water-soluble components is preferably used as the external additive externally added to the toner particles.

The term "wet process" used herein means a process in which a product is produced in a solvent through chemical reaction, and main processes thereof include a sulfuric acid process and a hydrochloric acid process.

In the sulfuric acid process, the following reaction proceeds in a liquid phase to form insoluble hydrous titanium oxide.

$$FeTio_3+2H_2SO_4 \rightarrow FeSO_4+TiOSO_4+2H_2O$$

$$TiOSO_4+2H_2O \rightarrow TiO(OH)_2+H_2SO_4$$

Further, in the hydrochloric acid process, titanium tetrachloride is first dissolved in water. In this case, the aqueous solution becomes an aqueous hydrochloric acid solution. Subsequently, a strong base such as sodium hydroxide is added to generate titanium hydroxide $Ti(OH)_4$, thereby precipitating titanium hydroxide.

Then, hydrous titanium hydroxide and titanium hydroxide are both converted to fine titanium oxide particles through the burning stage.

The amount of the water-soluble components contained in titanium oxide is preferably 0.2% by weight or less. When the amount of the water-soluble components is more than 0.2% by weight, the electrification amount is low, similarly to conventional titanium oxide, and does not sufficiently increase even if the titanium oxide is surface treated. However, when titanium oxide containing 0.2% by weight or less of the water-soluble components is used, the electrification amount increases, and a higher electrification amount is imparted when titanium oxide is surface treated. The reason for this is considered to be as follows.

Essentially, titanium oxide is quite insoluble in water and has no water-soluble components. However, titanium oxide produced by the wet process can not avoid remaining of a slight amount of water-soluble components due to its production process. Seeing this from the viewpoint of electrification property, the water-soluble components are presumed to reduce the electrification ability of titanium oxide. Previously, the electrification property has been said to be influenced by the environment of contact electrification and electric resistance of materials themselves.

Considering this point, it is presumed that remaining of the water-soluble components in titanium oxide powder gives water absorption to titanium oxide powder to make it easy to attract water, which causes a reduction in its own resistance, resulting in a decrease in electrification amount. Namely, it is reasoned that the resistance of the toner composition increases by removing or decreasing the water-soluble components, resulting in the retaining of a high electrification amount.

The water-soluble components include $K^+$, $Na^+$, $Li^+$, $Mg^{2+}$, $PO_4^{2-}$, $SO_4^{2-}$ and $Cl^-$ which are contained in flocculants used in the production process.

The amount of the water-soluble components is measured by boiling 250 ml of water containing 5 g of titanium oxide, evaporating to dryness 100 ml of a filtrate obtained by filtration after cooling, and weighing the residue. Details thereof are described in JIS K5116 (1973), Titanium Oxide (Pigment). The amount of the water-soluble components is measured based on JIS K5116 (1973), and indicated by % by weight of the above-described residue based on an amount of initial titanium oxide.

Treating agents for use in surface treatment of the fine titanium oxide particles include agents which react with hydroxyl groups. For example, coupling agents such as silane coupling agents, titanate coupling agents, aluminate coupling agents and zirconium coupling agents, silicone oils, etc. may be used. Of these, silane coupling agents represented the following general formulas or silicone oils are preferred:

$$R'_{4-x}Si(NCO)_x$$

$$R'_{4-x}Si(OR'_1)_x$$

$$R'_{4-x}SiCl_x$$

wherein x represents an integer of from 1 to 3, R' represents an alkyl group or a perfluoroalkyl group having from 1 to 16 carbon atoms, and $OR'_1$ represents an alkoxy group such as a methoxy group or an ethoxy group.

Specific examples thereof include $(CH_3)_2Si(NCO)_2$, $CH_3Si(NCO)_3$, $CH_3Si(OCH_3)_3$, $C_{10}H_{21}Si(OCH_3)_3$, $CF_3Si(OCH_3)_3$ and $CH_3Si(OC_2H_5)_3$, but agents in which x shown in the above-described formulas is 3 are preferred for increasing the electrification amount. For the same reason, R' is preferably an alkyl group or perfluoroalkyl group each having from 7 to 16 carbon atoms.

Examples of the silicone oil for use in the present invention include modified silicone oils, as well as dimethylsilicone, methylphenyl-silicone and monomethylsilicone and the like.

When the titanium oxide particles are externally added to the full color toner for electrostatic charge development of the present invention, the fine titanium oxide particles containing 0.2% by weight or less of the above-described water-soluble components are generally added so as to give an amount of 0.5 to 8 parts by weight, more preferably 0.5 to 5 parts by weight per 100 parts by weight of the toner particles. Further, the fine titanium oxide particles having an average particle size ranging from 5 to 100 nm are generally used. Other additives such as silica and alumina may be used in combination with titanium oxide.

The external additive can be allowed to adhere to the surfaces of the toner particles, for example, by use of a high-speed blender. Specifically, the toner particles and the external additive are mixed in a Henschel mixer or a V type blender.

The full color toner for electrostatic charge development of the present invention may be used as a non-magnetic single-component developer having no carrier, or tow-component developer having a carrier. However, in order to maximally exhibit the effects of the present invention, the toner of the present invention is preferably used as the two-component developers.

When the carrier is used, known carriers such as an iron powder carrier may be used without particular limitation. However, in order to maximally exhibit the effects of the present invention, a surface-coated ferrite carrier and a magnetic powder dispersion type carrier are preferably used. Further, the average particle size of the carrier is preferably from 20 to 80 μm, and more preferably from 30 to 60 μm.

Any known resins can be used as surface coating without particular limitation. For example, known resins such as styrene/acrylic resins, polyester resins, polyurethane resins, epoxy resins, silicone resins and polyamide resins may be used.

The present invention will be described in more detail with reference to production examples of the binder resin, production examples of the surface-treated titanium oxide, production examples of the melt flushing pigment, and Examples and Comparative Examples of the present invention, but the present invention should not be construed as being limited thereto.

1) Production Examples of Binder Resins

Resin Production Example 1

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |
| Terephthalic Acid: | 2.0 mol |
| n-Dodecenylsuccinic Acid: | 0.35 mol (7.5 mol %) |

The above-described raw material compounds were placed in a 2-liter four neck flask made of glass, and the flask was equipped with a stirring rod, a condenser, a nitrogen gas introducing pipe and a thermometer. Then, the flask was set on a mantle heater. The atmosphere in the reaction vessel was replaced by nitrogen gas, followed by the addition of 1 g of dibutyl tin oxide. Then, reaction was conducted at about 150° C. at ordinary pressure in the first half, and at 220° C. under reduced pressure in the latter half, each in a stream of nitrogen with heating with the mantle heater. Based on ASTM E28-51T, the softening point was traced, and when the softening point reached 115° C., the reaction was terminated, thereby adjusting the polymerization degree. After termination of the reaction, the reaction product was gradually cooled to room temperature. The glass transition temperature Tg of the resulting resin was 64° C. This resin is referred to as "resin (1)".

Resin Production Example 2

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |
| Terephthalic Acid: | 2.0 mol |
| n-Dodecenylsuccinic Acid: | 0.46 mol (10 mol %) |

The above-described raw material compounds were reacted under the same conditions as in Resin Production Example 1, and the reaction was terminated, when the softening point reached 110° C. After termination of the reaction, the reaction product was gradually cooled to room temperature. The glass transition temperature Tg of the resulting resin was 60° C. This resin is referred to as "resin (2)".

Resin Production Example 3

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |
| Terephthalic Acid: | 1.3 mol |
| n-Dodecenylsuccinic Acid: | 1.1 mol (23 mol %) |

The above-described raw material compounds were reacted under the same conditions as in Resin Production Example 1, and the reaction was terminated, when the softening point reached 105° C. After termination of the reaction, the reaction product was gradually cooled to room temperature. The glass transition temperature Tg of the resulting resin was 57° C. This resin is referred to as "resin (3)".

Resin Production Example 4

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |
| Terephthalic Acid: | 1.8 mol |
| Isooctenylsuccinic Acid: | 0.5 mol (10 mol %) |

The above-described raw material compounds were reacted under the same conditions as in Resin Production Example 1, and the reaction was terminated, when the softening point reached 115° C. After termination of the reaction, the reaction product was gradually cooled to room temperature. The glass transition temperature Tg of the resulting resin was 62° C. This resin is referred to as "resin (4)".

Resin Production Example 5

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |

-continued

| | |
|---|---|
| Terephthalic Acid: | 1.8 mol |
| n-Dodecylsuccinic Acid: | 0.5 mol (10 mol %) |

The above-described raw material compounds were reacted under the same conditions as in Resin Production Example 1, and the reaction was terminated, when the softening point reached 113° C. After termination of the reaction, the reaction product was gradually cooled to room temperature. The glass transition temperature Tg of the resulting resin was 60° C. This resin is referred to as "resin (5)".

Comparative Resin Production Example 1

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |
| Terephthalic Acid: | 2.0 mol |
| n-Dodecenylsuccinic Acid: | 0.3 mol (6.5 mol %) |

The above-described raw material compounds were reacted under the same conditions as in Resin Production Example 1, and the reaction was terminated, when the softening point reached 115° C. After termination of the reaction, the reaction product was gradually cooled to room temperature. The glass transition temperature Tg of the resulting resin was 65° C. This resin is referred to as "comparative resin (1)".

Comparative Resin Production Example 2

| | |
|---|---|
| Polyoxyethylene(2.2)-2,2-bis(4-hydroxyphenyl)-propane: | 1.3 mol |
| Polyoxypropylene(2.2)-2,2-bis(4-hydroxyphenyl)-propane: | 1.0 mol |
| Terephthalic Acid: | 1.1 mol |
| n-Dodecenylsuccinic Acid: | 1.25 mol (26 mol %) |

The above-described raw material compounds were reacted under the same conditions as in Resin Production Example 1, and the reaction was terminated, when the softening point reached 100° C. After termination of the reaction, the reaction product was gradually cooled to room temperature. The glass transition temperature Tg of the resulting resin was 53° C. This resin is referred to as "comparative resin (2)".

Comparative Resin Production Example 3

| | |
|---|---|
| Polyoxyethylene(2.2)-2,2-bis(4-hydroxyphenyl)propane: | 1.3 mol |
| Polyoxypropylene(2.2)-2,2-bis(4-hydroxyphenyl)propane: | 1.0 mol |
| Terephthalic Acid: | 2.3 mol |

The above-described raw material compounds were reacted under the same conditions as in Resin Production Example 1, and the reaction was terminated, when the softening point reached 120° C. After termination of the reaction, the reaction product was gradually cooled to room temperature. The glass transition temperature Tg of the resulting resin was 63° C. This resin is referred to as "comparative resin (3)".

Comparative Resin Production Example 4

| | |
|---|---|
| Polyoxyethylene(2.2)-2,2-bis(4-hydroxyphenyl)-propane: | 2.3 mol |
| Terephthalic Acid: | 1.7 mol |
| n-Dodecenylsuccinic Acid: | 0.6 mol (13 mol %) |

The above-described raw material compounds were reacted under the same conditions as in Resin Production Example 1, and the reaction was terminated, when the softening point reached 110° C. After termination of the reaction, the reaction product was gradually cooled to room temperature. The glass transition temperature Tg of the resulting resin was 57° C. This resin is referred to as "comparative resin (4)".

2) External Additives

Production Examples of Surface-Treated Titanium Oxide

In the production of the following additives (a) to (f), a rutile form titanium oxide (MT-150A, manufactured by Teika Co.) having an average particle size of 15 nm produced by a sulfuric acid-wet process was used except for additives (d) and (e). This titanium oxide contained 0.30% by weight of water-soluble components.

Additive (a)

Ten grams of fine titanium oxide powder which had been washed with water to reduce the amount of water-soluble components to 0.11% by weight was added to a methanol-water (95:5 by weight) mixed solvent in which 1.0 g of methyltrimethoxysilane had been dissolved, and the resulting mixture was subjected to ultrasonic dispersion. Then, methanol and the like were evaporated from the dispersion with an evaporator. After drying, the residue was heat treated with a dryer set to 120° C., and pulverized in a mortar to obtain titanium oxide having a water soluble content of 0.11% by weight which was surface treated with methyltrimethoxysilane.

Additive (b)

Ten grams of fine titanium oxide powder which had been washed with water to reduce the amount of water-soluble components to 0.08% by weight was added to a methanol-water (95:5) mixed solvent in which 2.0 g of decyltrimethoxysilane had been dissolved, and the resulting mixture was subjected to ultrasonic dispersion. Thereafter, treatment was conducted in the same manner as in the production of additive a to obtain titanium oxide having a water soluble content of 0.08% by weight which was surface treated with decyltrimethoxysilane.

Additive (c)

Ten grams of fine titanium oxide powder which had been washed with water to reduce the amount of water-soluble components to 0.13% by weight was added to toluene in which 2.0 g of a silicone oil (KF99, manufactured by Shin-Etsu Chemical Co. Ltd) had been dissolved, and the resulting mixture was subjected to ultrasonic dispersion. Then, toluene was evaporated from the dispersion with an evaporator. After drying, the residue was heat treated with a dryer set to 140° C., and pulverized in a mortar to obtain titanium oxide having a water soluble content of 0.13% by weight which was surface treated with the silicone oil.

Additive (d)

Ten grams of fine wet titanium oxide powder (TTO-55, manufactured by Ishihara Sangyo Kaisha, Ltd.) containing 0.05% by weight or less of water-soluble components which had been obtained by a hydrochloric acid-wet process was added to a methanol-water (95:5) mixed solvent in which 1.5 g of decyltrimethoxysilane had been dissolved, and the resulting mixture was subjected to ultrasonic dispersion. Thereafter, treatment was conducted in the same manner as in the production of additive a to obtain titanium oxide having a water soluble content of 0.05% by weight or less which was surface treated with decyltrimethoxysilane.

Additive (e)

Rutile titanium oxide (MT-500B, manufactured by Teika Co.) having an average particle size of 40 nm produced by a sulfuric acid-wet process was used. This titanium oxide contained 0.30% by weight of water-soluble components. This fine titanium oxide powder was washed with water in the same manner as in the production of Additive (a) to reduce the amount of water-soluble components to 0.10% by weight. Using this washed titanium oxide, treatment was conducted in the same manner as in the production of additive (b) to obtain titanium oxide having a water soluble content of 0.30% by weight which was surface treated with decyltrimethoxysilane.

Additive (f)

Fine titanium oxide powder (containing 0.30% by weight of water-soluble components) not washed with water was treated under the same conditions as in the production of additive (b) to obtain titanium oxide having a water soluble content of 0.30% by weight which was surface treated with decyltrimethoxy-silane.

Additive (g)

Titanium oxide (T805, manufactured by Nippon Aerosil Co. Ltd.) having an average particle size of 30 nm which had been produced by the dry process of vaporizing titanium tetrachloride to react it with water having a water soluble content of 0.26 % by weight which was surface treated with octyltrimethoxysilane was used as additive (g).

3) Production Examples of Pigments

Pigment Production Example 1

Production of Cyan Melt Flushing Pigment

Sixty-two parts of a cyan pigment (C. I. Pigment Blue 15:3) having a moisture content of 30% by weight was added to 100 parts of resin (2), and the mixture was melt-kneaded in a pressure kneader having a volume of 3 liters to evaporate the moisture, thereby obtaining cyan melt flushing pigment (a) having a pigment content of 30% by weight as follows.

That is, 50 parts of resin (2) was placed in the pressure kneader previously heated to 110° C., and a rotor was driven for rotation at a peripheral speed of 20 rpm under a pressure of 3 kgf/cm$^2$ to melt the resin. Then, 30 parts of hydrous paste of the cyan pigment was added thereto, followed by kneading for about 15 minutes, and 30 parts of resin (2) was further added, followed by kneading for about 15 minutes.

Thereafter, 20 parts of hydrous paste of the cyan pigment was added, followed by kneading for about 15 minutes, and 20 parts of resin (2) was further added, followed by kneading for about 15 minutes. Then, 12 parts of hydrous paste of the cyan pigment was added thereto, followed by kneading for about 30 minutes, thereby obtaining cyan melt flushing pigment (a).

Pigment Production Example 2

Production of Cyan Melt Flushing Pigment

Sixty parts of a cyan pigment (C. I. Pigment Blue 15:3) having a moisture content of 30% by weight was added to 100 parts of resin (2), and the mixture was melt-kneaded in a pressure kneader previously heated to about 100° C. in which a rotor was driven for rotation at a peripheral speed of 20 cm/second for 20 minutes under a pressure of at 3 kgf/cm$^2$ to melt the resin, thereby obtaining cyan melt flushing pigment (b) having a pigment content of 30% by weight.

Pigment Production Example 3

Production of Magenta Melt Flushing Pigment

Magenta melt flushing pigment having a pigment content of 30% by weight was obtained in the same manner as in Pigment Production Example 1 except that sixty-two parts of the cyan pigment was replaced with the same parts of a magenta pigment (C. I. Pigment Red 57:1) having a moisture content of 30% by weight.

Pigment Production Example 4

Production of Yellow Melt Flushing Pigment

Yellow melt flushing pigment having a pigment content of 30% by weight was obtained the same manner as in Pigment Production Example 1 except that sixty-two parts of the cyan pigment was replaced with the same parts of a yellow pigment (C. I. Pigment Yellow 17) having a moisture content of 30%.

Pigment Production Example 5

Production of Comparative Cyan Pigment

Seventy parts of resin (2) was melted in a heated pressure kneader, and then, 30 parts of a blue pigment (C. I. Pigment Blue 15:3, KET BLUE, manufactured by DIC, Inc.) was gradually added thereto. The total amount of the pigment was added, followed by melt-kneading at a temperature of 115° C. and under a pressure of 3 kgf/cm$^2$. After cooling, the resulting product was subjected to crude pulverization treatment to obtain a comparative cyan pigment having a pigment content of 30% by weight.

EXAMPLE 1

| | |
|---|---|
| Resin-1 | 96 parts |
| Carbon Black (primary particle size: 48 nm) | 4 parts |

The above-described components were melt-kneaded in a Bumbury mixer. After cooling, the mixture was pulverized with a jet type pulverizer, and the particle size distribution was made uniform with a classifier. For the particle size of the resulting toner, the 50% volume average particle diameter (d50) was 7.2 μm and the volume average particle size distribution (d16/d84) was 1.7 (measured with a Coulter counter). The proportion of the dispersed pigment particle having an average circle-corresponding diameter of 0.3 μm or more was 0% in the toner.

EXAMPLE 2

A toner was prepared by the method shown in Example 1 with the exception that resin (1) was replaced by resin (2).

For the particle size of the resulting toner, the 50% volume average particle diameter (d50) was 7.4 μm and the volume average particle size distribution (d16/d84) was 1.7. The proportion of the dispersed pigment particle having an average circle-corresponding diameter of 0.3 μm or more was 0% in the toner.

EXAMPLE 3

A toner was prepared by the method shown in Example 1 with the exception that resin (1) was replaced by resin (3).

For the particle size of the resulting toner, the 50% volume average particle diameter (d50) was 7.2 μm and the volume average particle size distribution (d16/d84) was 1.6. The proportion of the dispersed pigment particle having an average circle-corresponding diameter of 0.3 μm or more was 0% in the toner.

EXAMPLE 4

A toner was prepared by the method shown in Example 1 with the exception that resin (1) was replaced by resin (4).

For the particle size of the resulting toner, the 50% volume average particle diameter (d50) was 7.3 μm and the volume average particle size distribution (d16/d84) was 1.7. The proportion of the dispersed pigment particle having an average circle-corresponding diameter of 0.3 μm or more was 0% in the toner.

EXAMPLE 5

A toner was prepared by the method shown in Example 1 with the exception that resin (1) was replaced by resin (5).

For the particle size of the resulting toner, the 50% volume average particle diameter (d50) was 6.8 μm and the volume average particle size distribution (d16/d84) was 1.7. The proportion of the dispersed pigment particle having an average circle-corresponding diameter of 0.3 μm or more was 0% in the toner.

COMPARATIVE EXAMPLE 1

A toner was prepared by the method shown in Example 1 with the exception that resin (1) was replaced by comparative resin (1).

For the particle size of the resulting toner, the 50% volume average particle diameter (d50) was 7.3 μm and the volume average particle size distribution (d16/d84) was 1.6. The proportion of the dispersed pigment particle having an average circle-corresponding diameter of 0.3 μm or more was 0% in the toner.

COMPARATIVE EXAMPLE 2

A toner was prepared by the method shown in Example 1 with the exception that resin (1) was replaced by comparative resin (2).

For the particle size of the resulting toner, the 50% volume average particle diameter (d50) was 7.3 μm and the volume average particle size distribution (d16/d84) was 1.7. The proportion of the dispersed pigment particle having an average circle-corresponding diameter of 0.3 μm or more was 0% in the toner.

COMPARATIVE EXAMPLE 3

A toner was prepared by the method shown in Example 1 with the exception that resin (1) was replaced by comparative resin (3).

For the particle size of the resulting toner, the 50% volume average particle diameter (d50) was 7.0 μm and the volume average particle size distribution (d16/d84) was 1.7. The proportion of the dispersed pigment particle having an average circle-corresponding diameter of 0.3 μm or more was 0% in the toner.

COMPARATIVE EXAMPLE 4

A toner was prepared by the method shown in Example 1 with the exception that resin (1) was replaced by comparative resin (4).

For the particle size of the resulting toner, the volume average particle diameter (d50) was 7.0 μm and the volume average particle size distribution (d16/d84) was 1.7. The proportion of the dispersed pigment particle having an average circle-corresponding diameter of 0.3 μm or more was 0% in the toner.

Evaluation of Crease Fixing Strength

To each of the above-described toners, fine silica powder (R812, manufactured by Nippon Aerosil Co., Ltd.) was added as an external additive in an amount of 0.6 part per 100 parts of toner, and additive (a) was added in an amount of 0.8 part per 100 parts of toner, followed by mixing in a Henschel mixer.

Eight parts of the resulting toner to which the additives were externally added was mixed with 100 parts of a ferrite carrier coated with a styrene-methyl methacrylate polymer to prepare a developer, and an unfixed solid sample was prepared by use of a modified digital full color machine (Acolor, manufactured by Fuji Xerox Co., Ltd.). In this case, the weight of the toner per unit area in the solid sample was adjusted to 1.1 to 1.2 mg/cm$^2$. Paper used was paper for an Acolor machine.

In fixing, a fixing device for an Acolor machine was dismounted, and an off-line fixing device modified so as to be able to control the temperature of a heating roll was used. The temperature of the heating roll was controlled so as to give a gloss after fixing of about 40% (measured at 75-75 degrees/3GM-260 Type, manufactured by Murakami Sikisai Kenkyusho), thus obtaining a fixed image.

The resulting fixed sample was softly folded, and then, a roll (outer diameter: 60 mm) having a weight of about 500 g was rolled on the folded portion at a predetermined speed. Then, the crease of the fixed image was lightly rubbed with a soft dry cloth, followed by observation of the falling-off state of the image.

Evaluation was conducted according to the following criteria:

○: A crease was formed, but the falling off of an image was not or a little observed.

Δ: A white faint crease was intermittently observed.

x: A white band-like crease was clearly observed.

Evaluation of Powder Property

Two grams of each toner was placed on a test sieve having a mesh size of 75 μm, and the state of powder was observed while vibrating the test sieve and sucking the toner down the test sieve.

Evaluation was conducted according to the following criteria:

○: Toner particles exhibited good fluidity, so that they were all sucked by slight vibration.

Δ: Toner particles showed aggregation, but no flocculations were formed, and they were all sucked by vibration.

x: Toner particles showed strong aggregation, and flocculations were formed by vibration. All the toner particles were not sucked without strong vibration.

Evaluation of Toner Productivity

Pulverizing property (pulverization pressure is fixed): an amount pulverized per unit time The toner productivity was evaluated as a ratio based on (pulverizing property)×(classification efficiency) of the toner of Comparative Example 2.

○: 1.3 times or more

Δ: 1.1 times to less than 1.3 times x: Less than 1.1 times

Evaluation of Toner Preservability

Ten grams of each toner containing no additive was weighed and placed in a 50 cc beaker, which was allowed to stand in a thermostatic chamber maintained at a constant temperature and a constant humidity (47° C., 90% RH) for 20 hours. Then, it was allowed to stand at room temperature for 5 hours and cooled. The state of aggregation was observed by use of a spatula. Evaluation was conducted according to the following criteria:

○: No blocking was observed, and a toner showed a powdery state near to an untreated state.

Δ: Slight blocking was generated, but could be easily disaggregated by a press of the spatula. No fusion of powder was observed.

x: Strong blocking was generated, and could not disaggregated to powder even by a press of the spatula. Fusion of powder was observed.

TABLE 1

| Evaluated Sample | Crease Fixing Strength | Powder Property | Toner Productivity | Toner Preservability |
|---|---|---|---|---|
| Example 1 | ○ | ○ | ○ | ○ |
| Example 2 | ○ | Δ | Δ | ○ |
| Example 3 | ○ | ○ | ○ | ○ |
| Example 4 | ○ | ○ | ○ | ○ |
| Example 5 | ○ | ○ | ○ | ○ |
| Comparative Example 1 | ○ | x | x | ○ |
| Comparative Example 2 | ○ | ○ | x | x |
| Comparative Example 3 | ○ | x | x | ○ |
| Comparative Example 4 | x | ○ | Δ | Δ |

EXAMPLE 6

In this example, the effect of adding an external additive was evaluated for developers in which toner composition containing an external additive was used.

Toner Composition (1)

To 100 parts of the toner of Example 2, 2.0 parts of additive (a) was added, and mixed in a Henschel mixer to obtain toner composition (1).

Toner Composition (2)

To 100 parts of the toner of Example 2, 2.0 parts of additive (b) was added, and mixed in a Henschel mixer to obtain toner composition (2).

Toner Composition (3)

To 100 parts of the toner of Example 2, 2.0 parts of additive (c) was added, and mixed in a Henschel mixer to obtain toner composition (3).

Toner Composition (4)

To 100 parts of the toner of Example 2, 4.0 parts of additive (d) was added, and mixed in a Henschel mixer to obtain toner composition (4).

Toner Composition (5)

To 100 parts of the toner of Example 2, 2.0 parts of additive (e) was added, and mixed in a Henschel mixer to obtain toner composition (5).

Toner Composition (6)

To 100 parts of the toner of Example 2, 2.0 parts of additive (f) was added, and mixed in a Henschel mixer to obtain toner composition (6).

Toner Composition (7)

To 100 parts of the toner of Example 2, 2.0 parts of additive (g) was added, and mixed in a Henschel mixer to obtain toner composition (7).

Toner Composition (8)

To 100 parts of the toner of Example 2, 2.0 parts of fine hydrophobic silica powder (R972, manufactured by Nippon Aerosil Co., Ltd.) was added, and mixed in a Henschel mixer to obtain toner composition (8).

Production of Developers

Using a ferrite carrier having a particle size of about 50 μm which was coated with a styrene-methyl methacrylate copolymer, each of the above-described toner compositions 1 to 8 was added to the carrier in an amount of 8 parts per 100 parts of carrier. Then, the mixture was mixed in a tumbler mixer for 1 minute. The resulting developers 1 to 8 were subjected to a copy test.

For these developers 1 to 8, the copy test was run using an electrophotographic copying machine (Acolor 630, manufactured by Fuji Xerox Co., Ltd.), and the electrification amount, the charge distribution and the amount of reversed polar toner under the circumstances of high temperature and high humidity (30° C., 85% RH) and low temperature and low humidity (10° C., 15% RH) were measured. Further, 1.7 parts of toner particles were mixed with 100 parts of each developer, and 5 seconds after mixing, the above-described respective values were measured to evaluate the admixing property of toner.

The electrification amount is a value determined by image analysis of the charge-spectrograph process (CSG), and the charge distribution is defined by a value obtained by dividing the difference between the electrification amount at 20% of the cumulative integration of the charge distribution (Q20) and the electrification amount at 80% thereof (Q(80)) by the electrification amount at 50% thereof (Q(50)). That is, $$\text{Charge distribution}=\{Q(80)-Q(20)\}/Q(50)$$

Results of measurement after mixing each toner composition with the carrier for 1 minute are shown in Table 2, and results of evaluation of the admixing property of toner shown in Table 3.

TABLE 2

| | High Temperature and High Humidity | | | Low Temperature and Low Humidity | | |
|---|---|---|---|---|---|---|
| Developer No. | Electrification Amount (μC/g) | Charge Distribution | Amount of Reversed Polar Toner (wt %) | Electrification Amount (μC/g) | Charge Distribution | Amount of Reversed Polar Toner (wt %) |
| 1 | −15.0 | 0.5 | 0 | −17.5 | 0.5 | 0 |
| 2 | −16.0 | 0.5 | 0 | −18.3 | 0.6 | 0 |
| 3 | −13.0 | 0.5 | 0 | −16.0 | 0.6 | 0 |
| 4 | −17.0 | 0.5 | 0 | −18.7 | 0.6 | 0 |
| 5 | −14.3 | 0.5 | 0 | −16.7 | 0.6 | 0 |
| 6 | −6.8 | 0.6 | 0 | −8.9 | 0.5 | 0 |
| 7 | −12.6 | 1.0 | 0 | −16.8 | 1.0 | 0 |
| 8 | −14.2 | 0.9 | 5 | −28.6 | 1.0 | 2 |

TABLE 3

| | High Temperature and High Humidity | | | Low Temperature and Low Humidity | | |
|---|---|---|---|---|---|---|
| Developer No. | Electrification Amount (μC/g) | Charge Distribution | Amount of Reversed Polar Toner (wt %) | Electrification Amount (μC/g) | Charge Distribution | Amount of Reversed Polar Toner (wt %) |
| 1 | −13.5 | 0.6 | 0 | −16.3 | 0.6 | 0 |
| 2 | −15.3 | 0.6 | 0 | −17.5 | 0.7 | 0 |
| 3 | −12.4 | 0.6 | 0 | −15.7 | 0.6 | 0 |
| 4 | −14.0 | 0.6 | 0 | −16.3 | 0.6 | 0 |
| 5 | −13.2 | 0.6 | 0 | −15.6 | 0.5 | 0 |
| 6 | −5.2 | 0.7 | 0 | −7.3 | 0.6 | 0 |
| 7 | −11.3 | 0.7 | 5 | −13.2 | 0.7 | 5 |
| 8 | −12.3 | 0.9 | 15 | −25.2 | 0.9 | 14 |

In the present invention, when toner compositions 1 to 5 were used, the electrification amount hardly changed even under the circumstances of high temperature and high humidity, and low temperature and low humidity, and the electrification amount distribution was also very sharp.

Using these toner compositions, the copy test of 10,000 copies was run. As a result, although stains in device were slightly observed for toner composition 3, there were generally no fluctuations in the density of the printed image due to environmental fluctuations and no background stains, and stable images could be obtained.

However, for toner component 6 to which titanium oxide containing 0.30% by weight of water-soluble components was externally added, the electrification amount was low, and a little background stains were observed, even though the titanium oxide used was surface treated.

As to toner composition 8 to which hydrophobic silica was externally added, fluctuations in electrification amount due to environmental fluctuations were great, the charge distribution was wide, and electrification upon supplementing toner required much times.

For toner composition 7 to which titanium oxide produced by the dry process and surface treated was externally added, fluctuations in electrification amount due to environmental fluctuations were small, but background stains and cloud developed a little depending on the environment at about 3,000 copies in the copy test.

EXAMPLE 7

16.7 parts of cyan melt flushing pigment (a) and 83.7 parts of resin (2) were preliminarily mixed, followed by melt-kneading in a Bumbury mixer. After cooling, the mixture was pulverized in a jet mill, and classified to obtain a cyan toner having a pigment content of 4% by weight, a 50% volume average particle diameter (d50) of 5.5 μm and a volume average particle size distribution (d16/d84) of 1.6. The proportion of the dispersed pigment particles having an average circle-corresponding diameter of 0.3 μm or more was 0% in the toner.

To 100 parts of this cyan toner, 2 parts of additive (b) and 3 parts of additive (e) were added as external additives, and mixed in a Henschel mixer to obtain a cyan toner containing external additives.

Ten parts of the cyan toner containing the external additives was mixed with 100 parts of a ferrite carrier coated with a styrene-methyl methacrylate polymer to prepare a cyan developer.

COMPARATIVE EXAMPLE 5

16.7 parts of the comparative cyan pigment and 83.3 parts of resin (2) were preliminarily mixed, followed by treatment in the same manner as in Example 7. Thus, a cyan toner having a pigment content of 4% by weight, a 50% volume average particle diameter (d50) of 5.7 μm and a volume average particle size distribution (d16/d84) of 1.6 was obtained. The same external additives were added to this cyan toner in the same manner as in Example 7 to obtain a cyan toner containing the external additives, which was further mixed with a carrier in the same manner as in Example 7 to prepare a cyan developer. The proportion of the dispersed pigment particles having an average circle-corresponding diameter of 0.3 μm or more was 3% in the toner.

COMPARATIVE EXAMPLE 6

| | |
|---|---|
| Polyoxyethylene(2.2)-2,2-bis(4-hydroxyphenyl)propane (molecular weight: 300): | 1.3 mol |
| Polyoxypropylene(2.2)-2,2-bis(4-hydroxyphenyl)propane (molecular weight: 326): | 0.9 mol |
| Terephthalic Acid (molecular weight: 166): | 1.1 mol |
| Fumaric Acid: | 1.1 mol |

The above-described raw material compounds were reacted under the same conditions as in Resin Production Example 1. The resulting polyester resin had a glass transition temperature (Tg) of 58° C., a softening point of 100° C. and a weight average molecular weight of 8,500.

100 parts of this polyester resin, 5 parts of a cyan pigment (C. I. Pigment Blue 15:3) and 5 parts of a graft-modified polyolefin obtained by polymerizing styrene, acrylic acid and polyethylene at a ratio of 8:2:100 in terms of parts by weight were preliminarily mixed, followed by melt-kneading in a Bumbury mixer. After cooling, the mixture was pulverized in a jet mill, and classified to obtain a cyan toner having a pigment content of 4% by weight, a 50% volume average particle diameter (d50) of 5.3 μm and a volume average particle size distribution (d16/d84) of 1.6. The proportion of the dispersed pigment particles having an average circle-corresponding diameter of 0.3 μm or more was 7% in the toner.

To 100 parts of this cyan toner, 2 parts of additive (b) and 3 parts of additive (e) were added as external additives, and mixed in a Henschel mixer to obtain a cyan toner containing external additives.

Ten parks of this cyan toner containing external additives was mixed with 100 parts of a ferrite carrier coated with a styrene-methyl methacrylate polymer and having a particle size of 50 μm to prepare a cyan developer.

OHP Copy Sample Test

Using each of the developers of Example 7 and Comparative Examples 5 and 6, a solid original was copied with a modified digital full color machine (Acolor, manufactured by Fuji Xerox Co., Ltd.) at a monochromatic cyan mode/OHP mode to form an OHP copy sample. The resulting samples were projected by use of an OHP to compare them in terms of transparency and clearness.

As a result, the cyan developer of Example 7 showed high transparency and also high color clearness. On the other hand, the cyan developers of Comparative Examples 5 and 6 showed cloudy color and clearness inferior to that obtained by the cyan developer of Example 7.

EXAMPLE 8

14 parts of the magenta melt flushing pigment (Production Example 3) and 86 parts of resin (2) were preliminarily mixed, followed by treatment in the same manner as in Example 7 to obtain a magenta toner having a pigment content of 4% by weight, a 50% volume average particle diameter (d50) of 5.3 μm and a volume average particle size distribution (d16/d84) of 1.6. External additives were added to this magenta toner in the same manner as in Example 7 to obtain a magenta toner containing the external additives, which was further mixed with a carrier in the same manner as with Example 7 to prepare a magenta developer. The proportion of the dispersed pigment particles having an average circle-corresponding diameter of 0.3 μm or more was 0% in the toner.

EXAMPLE 9

16.7 parts of the yellow melt flushing pigment (Production Example 4) and 83.3 parts of resin (2) were preliminarily mixed, followed by treatment in the same manner as in Example 7. Thus, a yellow toner having a pigment content of 4% by weight, a volume average particle diameter (d50) of 5.4 μm and a volume average particle size distribution (d16/d84) of 1.6 was obtained. External additives were added to this yellow toner in the same manner as in Example 7 to obtain a yellow toner containing the external additives, which was further mixed with a carrier in the same manner as in Example 7 to prepare a yellow developer. The proportion of the dispersed pigment particles having an average circle-corresponding diameter of 0.3 μm or more was 0% in the toner.

EXAMPLE 10

Four parts of carbon black (#25, manufactured by Mitsubishi Kasei Corp., primary particle size: 48 nm) and 96 parts of resin (2) were melt-kneaded in a Bumbury mixer. After cooling, the mixture was pulverized with a jet type pulverizer, and the particle size distribution was made uniform with a classifier to obtain a black toner having a 50% volume average particle diameter (d50) of 7.2 μm and a volume average particle size distribution (d16/d84) of 1.7.

To 100 parts of this black toner, 1.4 parts of additive (b) and 2 parts of additive (e) were added as external additives, and mixed in a Henschel mixer to obtain a black toner containing the external additives.

Ten parts of this black toner containing external additives was mixed with 100 parts of a ferrite carrier coated with a styrene-methyl methacrylate polymer to prepare a black developer. The proportion of the dispersed pigment particles having an average circle-corresponding diameter of 0.3 μm or more was 0% in the toner.

EXAMPLE 11

An Acolor digital full color machine manufactured by Fuji Xerox Co., Ltd. was charged with the developer of Example 10 (primary particle size of carbon black: 48 nm), and a copy sample was prepared at a monochromatic black mode using a gray solid original having a halftone dot of from 10% to 80%.

COMPARATIVE EXAMPLE 7

Four parts of carbon black (Mogal L, manufactured by Cabot Co., primary particle size: 25 nm) and 96 parts of resin (1) were melt-kneaded in a Bumbury mixer. After cooling, the mixture was pulverized with a jet type pulverizer, and the particle size distribution was made uniform with a classifier to obtain a black toner having a 50% volume average particle diameter (d50) of 7.3 μm and a volume average particle size distribution (d16/d84) of 1.6. External additives were added to this black toner in the same manner as in Example 10 to obtain a black toner containing the external additives, which was further mixed with a carrier in the same manner as in Example 10 to prepare a black developer.

An Acolor digital full color machine manufactured by Fuji Xerox Co., Ltd. was charged with this developer, and a copy sample was prepared at a monochromatic black mode using a gray solid original having a halftone dot of from 10% to 80%.

Evaluation of Color Tone and Gray Balance

The copy sample obtained by using the developer of Comparative Example 7 showed a stronger reddish brown color tone than the sample obtained by using that of Example 11 under an A light source, and was poor in gray balance. In contrast, the copy sample obtained by using the developer of Example 11 showed no color deviation even under an A light source or a C light source, and color development showing good gray balance could be obtained, resulting in a very distinct and clear copy.

Evaluation and Comparison as Color Toner Kit Developers

The color toner developers of Examples 7 to 10 were used for full color development. A combination thereof was used as a color toner kit developer according to this invention.

The Acolor machine was charged with the above-described color toner kit developer to form a full color image by superposing a cyan color toner image, a magenta color toner image, a yellow color toner image and a black color toner image, one another. The full color image was evaluated in terms of the image quality stability. As a chart, an illustrated and lettered chart was used. Results are shown in Table 4.

A color toner kit developer for comparison was prepared in the following manner. A full color image was formed using the comparative color toner kit and evaluated in terms of the image quality stability in the same manner as described above. Results are shown in Table 4.

Comparative Cyan Toner

A cyan melt flushing pigment was obtained under the same conditions as in Pigment Production Example 1 except that resin (2) was replaced with the same parts of comparative resin (3). Using the resulting pigment and the above-described comparative resin (3), a cyan toner having a pigment content of 4% by weight, a 50% volume average particle diameter (d50) of 5.3 μm and a volume average particle size distribution (d16/d84) of 1.6 was obtained in the same manner as in Example 7. The proportion of the dispersed pigment particles having an average circle-corresponding diameter of 0.3 μm or more was 0% in the toner.

Comparative Magenta Toner

A magenta melt flushing pigment was obtained under the same conditions as in Pigment Production Example 3 except that resin (2) was replaced with the same parts of comparative resin (3). Using the resulting pigment and the above-described comparative resin (3), a magenta toner having a pigment content of 4% by weight, a 50% volume average particle diameter (d50) of 5.2 μm and a volume average particle size distribution (d16/d84) of 1.6 was obtained in the same manner as in Example 8. The proportion of the dispersed pigment particles having an average circle-corresponding diameter of 0.3 μm or more was 0% in the toner.

Comparative Yellow Toner

A yellow melt flushing pigment was obtained under the same conditions as in Pigment Production Example 4 except that resin (2) was replaced with the same parts of comparative resin (3). Using the resulting pigment and the above-described comparative resin (3), a yellow toner having a pigment content of 4% by weight, a 50% volume average particle diameter (d50) of 5.3 μm and a volume average particle size distribution (d16/d84) of 1.6 was obtained in the same manner as in Example 9. The proportion of the dispersed pigment particles having an average circle-corresponding diameter of 0.3 μm or more was 0% in the toner.

Comparative Black Toner

The toner prepared in Comparative Example 3 was used.

To 100 parts of each the above-described cyan, magenta and yellow toners, 2 parts of additive (b) and 3 parts of additive (e) were added as external additives, and mixed in a Henschel mixer to obtain cyan, magenta and yellow toners each containing the external additives, respectively.

Further, to 100 parts of the above-described black toner, 1.4 parts of additive (b) and 2 parts of additive (e) were added as external additives, and mixed in a Henschel mixer to obtain a black toner containing the external additives.

Each 10 parts of these four-color toners containing the external additives was mixed with 100 parts of a ferrite carrier coated with a styrene-methyl methacrylate polymer and having a particle size of 50 μm to prepare a color toner kit developer for comparison.

TABLE 4

| | 10,000 Copies | 20,000 Copies | 30,000 Copies | 50,000 Copies |
|---|---|---|---|---|
| Color Toner Kit of the Invention | ○ | ○ | ○ | ○ |
| Color Toner Kit for Comparison | ○ | ○ | Δ | x |

○: No fog was observed on a background portion. The image quality was stable

Δ: Fog was a little observed, but there was practically no problem in practical use.

x: Fog was markedly observed. Also for the image quality, unclearness was partially observed.

The color toner and the black toner for electrostatic charge development of the present invention are constituted as described above. They are therefore excellent in transparency, color reproduction, clearness, reproduction of black gradation and color tone balance, and can form full color copy images having a high fixing strength. Further, the developers using the color toner and the black toner for electrostatic charge development of the present invention are excellent in environmental stability, suitable for use in the heat roller fixing process, and make it possible to form full color images of good image quality stably.

Furthermore, the color toners for electrostatic charge development are excellent in pulverizing property and classification property, and also good in powder fluidity, so that the productivity of the toner can be significantly improved.

In addition, external addition of the above-described specific titanium oxide improves the environmental charging property of the toner, which makes it possible to provide an stable full color copy image for a long period of time.

While the invention has been described in detail and with reference to specific examples thereof, it will be apparent to one skilled in the art that various changes and modifications can be made therein without departing from the spirit and scope thereof.

What is claimed is:

1. A color toner for electrostatic charge development comprises a binder resin and a color colorant, wherein said binder resin comprises a polyester resin containing (a) an ethoxylated bisphenol type diol, (b) a propoxylated bisphenol type diol and (c) an aromatic dicarboxylic acid or an anhydride or ester thereof, as main monomer components, and said polyester resin further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said color colorant is a flushing pigment comprising hydrous paste of an organic pigment and said polyester resin.

2. The color toner according to claim 1, wherein said organic pigment is dispersed in said binder resin so that a proportion of the number Of dispersed pigment particles having a circle-corresponding diameter of 0.3 μm or more to the total number of the dispersed pigment particles being 0.1% or less.

3. The color toner according to claim 1, wherein said color toner further comprises an external additive.

4. The color toner according to claim 3, wherein said external additive is titanium oxide particles produced by a wet process.

5. The color toner according to claim 4, wherein said external additive contains a water-soluble components in an amount of 0.2% by weight or less based on the total weight thereof.

6. The color toner according to claim 4, wherein said external additive is surface treated with a surface treating agent.

7. The color toner according to claim 6, wherein said surface treating agent is a coupling agent or a silicone oil.

8. A method for producing a color toner for electrostatic charge development comprises the steps of:

melt-kneading in a heat-pressure type kneader (i) an organic pigment and (ii) a polyester resin containing (a) an ethoxylated bisphenol type diol (b) a propoxylated bisphenol type diol and (c) an aromatic dicarboxylic acid or an acid anhydride or ester thereof as main monomer components, and further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin to prepare a flushing pigment;

melt-kneading said flushing pigment and said polyester resin; and pulverizing and classifying the resulting melt-kneaded product.

9. The method according to claim 8, wherein said melt-kneading in the heat-pressure type kneader is conducted at a temperature of 100° to 150° C.

10. A black toner for electrostatic charge development comprises a binder resin and a black colorant, wherein said binder resin comprises a polyester resin containing (a) an ethoxylated bisphenol type diol and (b) a propoxylated bisphenol type diol and (c) an aromatic dicarboxylic acid or an acid anhydride or ester thereof as main monomer components, and further containing at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said black colorant is a carbon black having a primary particle size of from not less than 30 nm to not more than 50 nm.

11. A method for forming a full color image comprising at least a cyan color image, a magenta color image and a yellow color image, which comprises the steps of:

providing at least a cyan color toner image, a magenta color toner image and a yellow color toner image using respective color toners; and superposing at least said color toner images one another, wherein said respective color toners comprises a binder resin and a color colorant, wherein said binder resin comprises a polyester resin containing (a) an ethoxylated bisphenol type diol, (b) a propoxylated bisphenol type diol and (c) an aromatic dicarboxylic acid or an anhydride or ester thereof, as main monomer components, and said polyester resin further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said color colorant is a flushing pigment comprising hydrous paste of an organic pigment and said polyester resin.

12. A method for forming a full color image comprising at least a cyan color image, a magenta color image, a yellow color image and a black color image, which comprises the steps of:

providing at least a cyan color toner image, a magenta color toner image and a yellow color toner image using respective color toners, and further providing a black color toner image using a black toner; and superposing at least said color toner images one another, wherein said respective color toners comprises a binder resin and a color colorant, wherein said binder resin comprises a polyester resin containing (a) an ethoxylated bisphenol type diol, (b) a propoxylated bisphenol type diol and (c) an aromatic dicarboxylic acid or an anhydride or ester thereof, as main monomer components, and said polyester resin further containing (d) at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said color colorant is a flushing pigment comprising hydrous paste of an organic pigment and said polyester resin; and wherein said black toner comprises a binder resin and a black colorant, wherein said binder resin comprises a polyester resin containing (a) an ethoxylated bisphenol type diol and (b) a propoxylated bisphenol type diol and (c) an aromatic dicarboxylic acid or an acid anhydride or ester thereof as main monomer components, and further containing at least one compound selected from the group consisting of alkylsuccinic acids, acid anhydrides and esters thereof, alkenylsuccinic acids, and acid anhydrides and esters thereof in an amount of 7 to 25 mol % based on the total monomer amount of said polyester resin, and said black colorant is a carbon black having a primary particle size of from not less than 30 nm to not more than 50 nm.

13. The color toner according to claim 1, wherein a molar ratio of the ethoxylated bisphenol type diol to the propoxylated bisphenol type diol is from 1:10 to 10:1.

14. The method according to claim 8, wherein a molar ratio of the ethoxylated bisphenol type diol to the propoxylated bisphenol type diol is from 1:10 to 10:1.

15. The black toner according to claim 10, wherein a molar ratio of the ethoxylated bisphenol type diol to the propoxylated bisphenol type diol is from 1:10 to 10:1.

16. The method according to claim 11, wherein a molar ratio of the ethoxylated bisphenol type diol to the propoxylated bisphenol type diol is from 1:10 to 10:1.

17. The method according to claim 12, wherein a molar ratio of the ethoxylated bisphenol type diol to the propoxylated bisphenol type diol is from 1:10 to 10:1.

* * * * *